US005226573A

United States Patent [19]

Brugerolle et al.

[11] Patent Number: 5,226,573

[45] Date of Patent: Jul. 13, 1993

[54] METAL DISPENSING CONTAINER WITH AN EXTERNALLY CRIMPED VALVE CUP

[75] Inventors: Piérre Brugerolle, Sainte Menehould; Philippe Mao, Bellegarde sur Valserine, both of France

[73] Assignee: Cebal SA, Clichy, France

[21] Appl. No.: 861,546

[22] Filed: Apr. 1, 1992

[30] Foreign Application Priority Data

Apr. 3, 1991 [FR] France ..... 91 04265

[51] Int. Cl.[5] ..... B65D 83/00

[52] U.S. Cl. ..... 222/402.1; 53/470; 413/4; 413/8

[58] Field of Search ..... 222/394, 402.1, 542; 53/470, 488; 413/4, 8, 7, 42, 43

[56] References Cited

U.S. PATENT DOCUMENTS

| | | | |
|---|---|---|---|
| 2,995,270 | 8/1961 | Henchert . | |
| 3,342,381 | 9/1967 | Simons et al. | 222/402.1 |
| 4,832,236 | 5/1989 | Greaves | 222/402.1 |

FOREIGN PATENT DOCUMENTS

| | | |
|---|---|---|
| 1196126 | 6/1970 | United Kingdom . |
| 2205614 | 12/1988 | United Kingdom . |

*Primary Examiner*—Gregory L. Huson

*Attorney, Agent, or Firm*—Dennison, Meserole, Pollack & Scheiner

[57] ABSTRACT

A metal dispensing container for contents under pressure comprising a neck portion with a diameter of over 22 mm and a cup-shaped valve portion. A clearance gap of at least 0.5 mm is left between the inside of the neck portion and the cup portion into which the neck portion is fitted following insertion of a seal. The outside of the cup-shaped portion is crimped over the neck portion so that deformation of the seal prevents leakage.

5 Claims, 3 Drawing Sheets

METAL DISPENSING CONTAINER WITH AN EXTERNALLY CRIMPED VALVE CUP

FIELD OF THE INVENTION

The invention concerns a metal dispensing container, normally known as an aerosol can in which the dispensing valve is crimped into the container. It also concerns the method of making the dispensing container.

STATE OF THE PRIOR ART

A dispensing container of the aerosol type, of whatever size and nature glass, plastics, etc.), includes the container itself which terminates at the top in a neck and dispensing valve. The distributing valve has to be fixed on the neck of the container so that the product contained is sealed in. It is also necessary for the valve fixing method not to cause any flaws in the external part of the valve which could be seen by the consumer. The valve proper is in the center of a small cup which is inserted in the neck of the container. The cup has an annular external edge which straddles the edge of the neck of the container.

The known procedure for fixing the valve cup is to crimp it onto the outside of the container with a clamp. The steps of this method are shown in FIGS. 1–3. The method is commonly used for plastic containers of all dimensions and for medium size metal containers, typically metal containers in which the neck has a diameter of approximately 20 mm. The crimping operation consists of turning in the outer skirt 1 of the cup 2 over the edge 3 of the neck. During the operation, the cup 2 is held on the neck by a force exerted downwardly. By the end of the operation, the seal 4 is thus compressed as shown in FIG. 3.

For larger size metal containers, typically those where the neck has a diameter of approximately 25 mm, the method normally used to fix the valve is a different one, known as dudgeoning. In this case, the valve cup has a special shape, substantially different from that of valve cups which are crimped. The steps of method are shown in FIGS. 4–6. The dudgeoning operation consists of deforming the valve cup 5 outwardly until it is in contact with the inside of the neck 6. By the end of the operation, the seal 4 is thus compressed.

BACKGROUND OF THE INVENTION

The manufacture and use of metal dispensing containers with a dudgeoned valve have disadvantages.

Firstly, during manufacture, the clamp and possibly the machine have to be changed, and the type of cup has to be changed so that plastic and metal distributing containers can be produced in succession. This means that there are interruptions in the production line and a double stock of crimping equipment and valves are required.

Secondly, dudgeoning is a tricky operation, more difficult than external crimping.

And finally, dispensing containers with an externally crimped valve cup generally have a better seal than those with a dudgeoned valve cup.

To avoid these disadvantages, applicants naturally tried to proceed to crimp valve cups externally onto large metal containers by the method conventionally used for medium size metal containers and plastic containers.

This conventional method comprises:

selecting a valve cup where the part which goes into the neck has an outside diameter substantially equal to the inside diameter of the neck, the outside diameter of the cup of the valve however being slightly less, typically 0.2 mm less, than the inside diameter of the neck in order to facilitate insertion.

placing an annular seal on the edge of the neck.

inserting the valve cup in the container.

turning in the outer skirt of the cup below the edge of the neck with a crimping clamp, thus causing the cup and seal to be gripped.

By using this known method, applicants did indeed obtain large metal dispensing containers with a crimped valve cup. However, tests carried out on samples thus obtained showed that the degree of tightness normally found in medium size metal dispensing containers with a crimped valve cup was not achieved. The same tests showed that the samples of large metal dispensing containers obtained, with a crimped valve cup, were no better sealed than dispensing containers of the same size with a dudgeoned valve cup.

The problem raised was thus to improve the degree of sealing tightness of large metal dispensing containers with an externally crimped valve cup.

Applicants have succeeded to solve the problem by modifying the assembly for the container with the valve cup.

OBJECTS OF THE INVENTION

The first object of the invention is in the sealing of a metal dispensing container in which the neck has a diameter of over 22 mm, wherein the cup of the dispensing valve is crimped onto the container and a clearance or gap of over 1 mm in diameter is present between the inside of the neck and the part of the valve cup which goes into the neck. A further object of the invention is a method of making the dispensing container.

DETAILED DESCRIPTION

Figure 1:
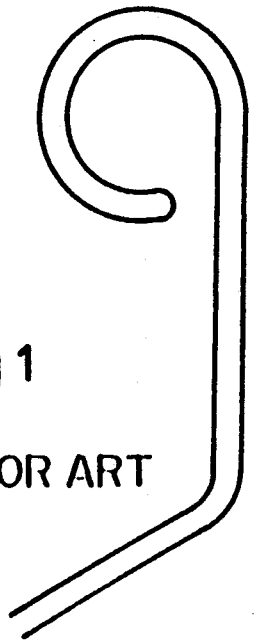
Fig 1 PRIOR ART
FIG. 1 shows the container top portion.
Figure 2:
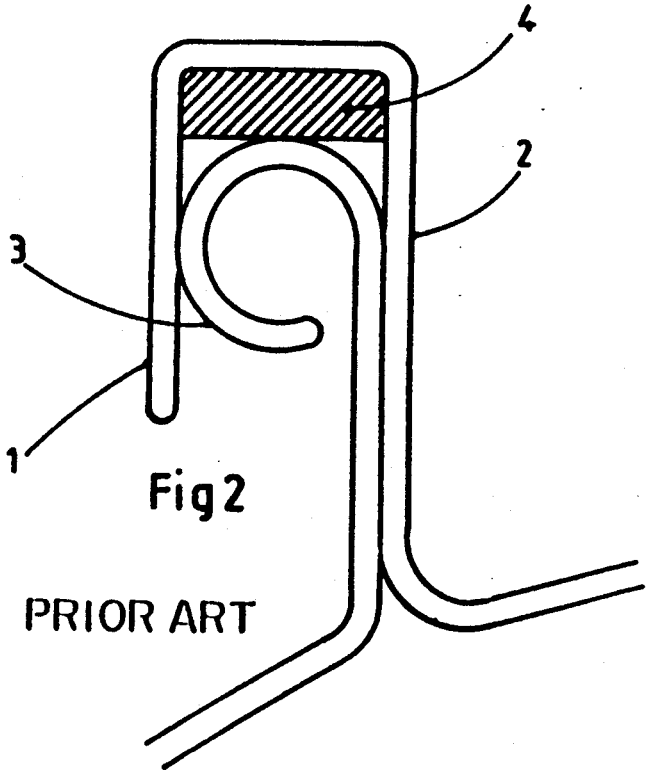
Fig 2 PRIOR ART
FIG. 2 shows the container valve unit before crimping.
Figure 3:
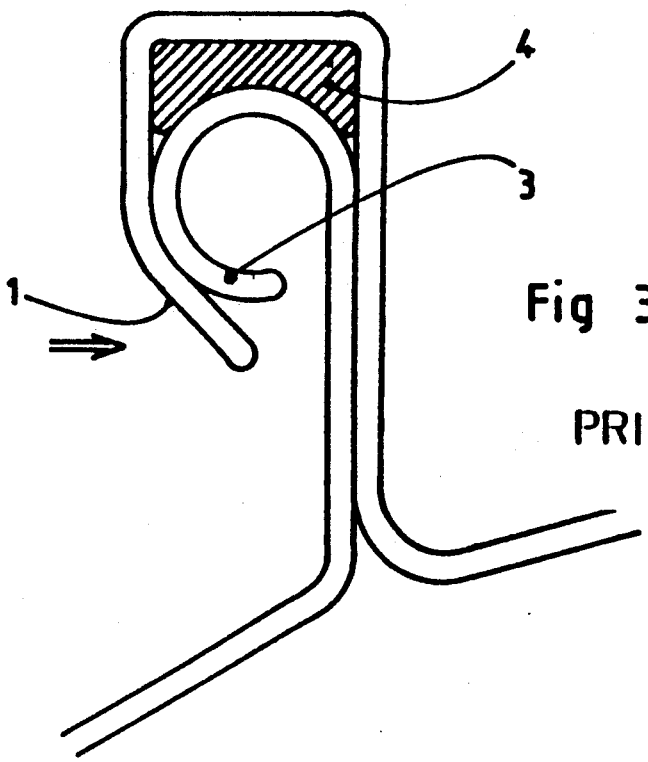
Fig 3 PRIOR ART
FIG. 3 shows the container valve unit after crimping.
Figure 4:
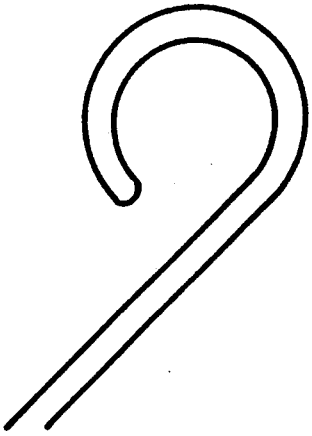
Fig 4 PRIOR ART
FIG. 4 shows the container top portion.
Figure 5:
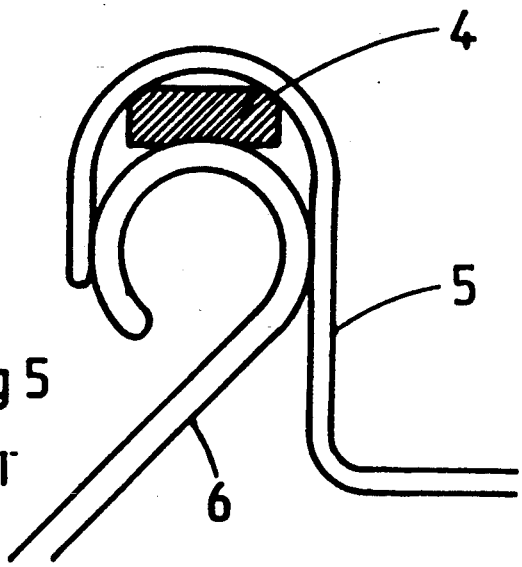
Fig 5 PRIOR ART
FIG. 5 shows the container valve unit before dudgeoning.
Figure 6:
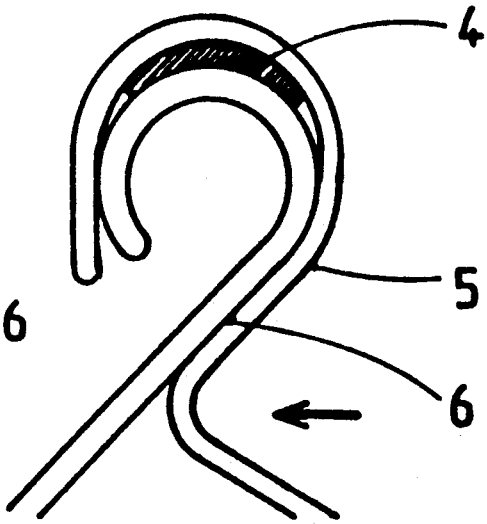
Fig 6 PRIOR ART
FIG. 6 shows the container valve unit after dudgeoning.
Figure 7:
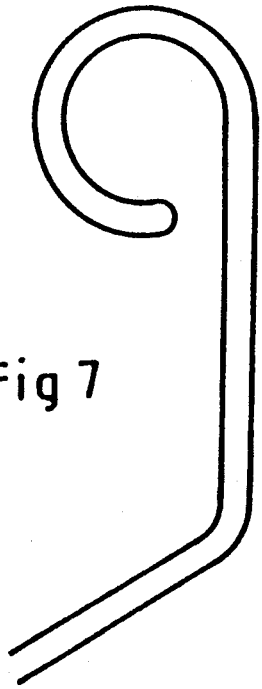
FIG. 7 shows the container top portion.

FIG. 7 shows the neck portion of a metal can or container with a neck having an inside diameter at least 22 mm, specifically 25–28 mm.

Figure 8:
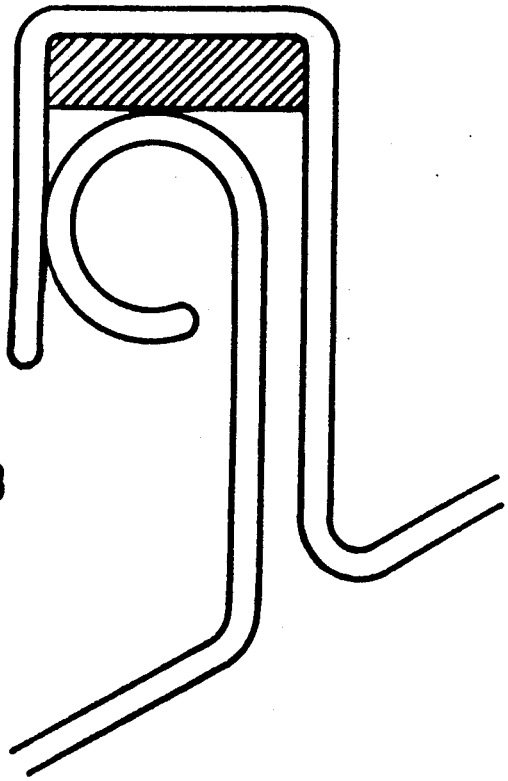
FIG. 8 shows the container valve unit before crimping.

FIG. 8 shows the neck portion, the cup shaped portion of the valved dispensing cap, an annular seal with the components placed so as to leave a radial clearance gap of 0.5 to 1.5 mm between the cup-shaped portion and the neck portion.

Figure 9:
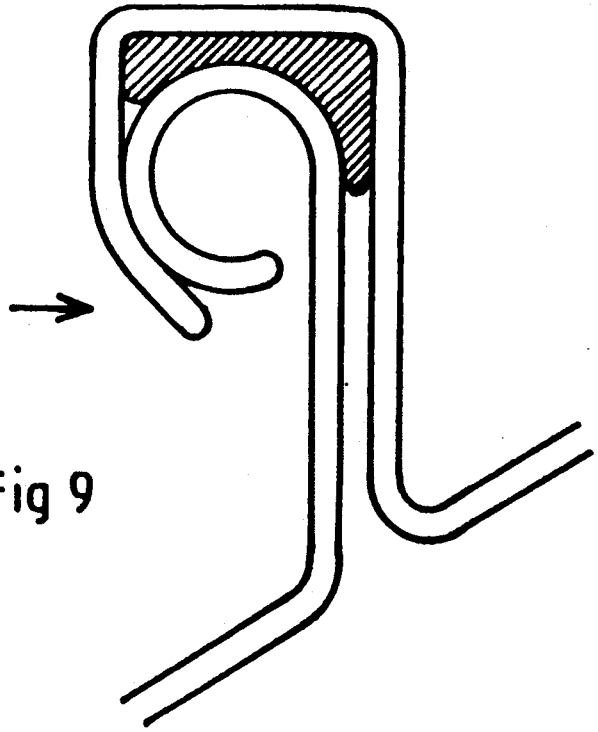
FIG. 9 shows the container valve unit according to the invention.

FIG. 9 shows the neck and cap portions after crimping. During the crimping step, the rectangular cross section of the seal is plastically deformed so that the cross section takes the form of an inverted L. Part of the sealing material above the gap is pressed into the gap so as to form the shorter leg of the L-shape. The contacting surface of the sealing material between the metal neck and cup portions is increased and results in the improved sealing effect. The exact shape of the desired sealing material is shown in the figure.

TEST RESULTS

In a first series of tests, applicants tried to change the profile of the edge of the neck of the container over which the outer skirt of the valve cup is turned in during external crimping. They expected to obtain more effective crimping and thus a better seal, but these changes in fact proved to be ineffective.

In a second series of tests, applicants were accidentally induced to try to crimp valve cups onto a container where the inside diameter of the neck was substantially larger than the outside diameter of the part of the cup which went into the neck, thus leaving a relatively large clearance between the neck and the cup. Despite the presence of the clearance which is a priori harmful to the seal, the dispensing containers thus obtained gave surprisingly improved results in the seal test.

A hypothesis has been worked out a posteriori to try to explain such a surprising result. It is as follows: During the crimping operation, the cup is held on the edge of the neck with a downward vertical force. This force and the actual crimping cause a flattening of the sealing material. When there is no clearance between the cup and the neck, the sealing material has no space within which it can be deformed. In cases where a clearance separates the cup from the neck, the sealing material can be deformed more easily and be more effective.

After obtaining this good result, applicants proceeded with many additional tests to confirm it. Thus, they found that the most advantageous range was a clearance from 1 to 3 mm in diameter. Beyond 3 mm, the sealing results are still satisfactory, but begin to deteriorate. Applicants also found that the invention was particularly important for dispensing containers with a neck diameter from 25 to 28 mm.

For all the test experiments carried out, the dispensing containers were subjected to the following seal test:

- the containers are filled with about 20 g of butane gas
- the containers thus filled are weighed after being stored at room temperature for 12 h
- the containers are stored for 30 days in a ventilated oven at a temperature of 50°
- they are removed from the oven and stored at room temperature for 24 hours
- all the containers are reweighed and the difference in weight from the first weighing is measured
- the loss is expressed in mg per day of storage at 50°.

TEST 1

A prior art dudgeoning process was applied to valve cups on 20 conventional aluminum containers where the inside diameter of the neck was 25.4 mm. The valve cups were of the "dudgeoning" type. The 20 dispensing containers thus obtained were subjected to the seal test. The average leakage rate for the 20 dispensing containers was 30 mg/day.

TEST 2

A prior art external crimping process was applied to valve cups on 20 conventional aluminum containers where the inside diameter of the neck was 25.4 mm. The outside diameter of the part of the cups which went into the neck was 25.2 mm. The average leakage rate measured for the 20 dispensing containers was 32 mg/day.

TEST 3

An external crimping process was applied to valve cups on 20 aluminum containers where the inside diameter of the neck was 26.9 mm. The outside diameter of the part of the cups to be inserted in the neck was 25.2 mm, the same as that of the cups in Test 2. The average leakage rate measured for the 20 dispensing containers was only 10 mg/day.

From the test results, it is abundantly clear that the inventive structure and method is an improvement over the prior art.

We claim:

1. A metal can for dispensing contents under pressure comprising:

a metal container having a neck portion with an inside diameter of at least 22 mm;

a cup-shaped portion for mounting a dispensing valve, said cup-shaped portion fitting over the neck portion and having an inside diameter so dimensioned as to leave a clearance gap of at least 0.5 mm between the inside of the neck portion and the part of the cup which is fitted over the neck portion, and an annular sealing means having a rectangle shaped cross section between the neck portion and the cup-shaped portion, said sealing means is subjected to plastic deformation by crimping said cup-shaped portion over the container neck portion so that the sealing means cross-section takes the form of an inverted L-shape having first and second legs, with one of the legs extending into the clearance gap and maintaining said clearance gap.

2. The metal can of claim 1 wherein the diameter of the neck portion is selected to be from 25 to 28 mm.

3. The metal can of claim 2 wherein the clearance gap is provided by selecting the neck portion inside diameter to be 1 to 3 mm larger than the outside diameter of the cup-shaped portion.

4. A method of making a metal can for dispensing contents under pressure comprising the following steps:

providing a metal container with a neck portion having an inside diameter of at least 22 mm, providing a cup-shaped portion for mounting a dispensing valve, said cup-shaped portion having an inside diameter so dimensioned as to leave a clearance gap of least 0.5 mm between the inside of the neck portion and the part of the cup when fitted over the neck portion, placing an annular seal having a rectangle shaped cross-section into the cup-shaped portion, inserting the neck portion into the cup-shaped portion so as to contact the seal, crimping the outer part of the cup-shaped portion over the neck portion so as to plastically deform said rectangle shaped cross-section of the seal into the form of an inverted L-shaped cross-section having first and second legs, one of the legs extending into the clearance gap and maintaining said clearance gap.

5. The method of claim 4 wherein the neck portion has an inside diameter 1 to 3 mm larger than the outside diameter of the cup-shaped portion.

* * * * *